US007296438B2

(12) United States Patent
Kolb

(10) Patent No.: US 7,296,438 B2
(45) Date of Patent: Nov. 20, 2007

(54) STONE MOUNT AND CLASP FOR JEWELRY

(76) Inventor: Ronald W. Kolb, 23 Wildwood Ave., White Bear Lake, MN (US) 55110-1626

( * ) Notice: Subject to any disclaimer, the term of this patent is extended or adjusted under 35 U.S.C. 154(b) by 519 days.

(21) Appl. No.: 10/727,673

(22) Filed: Dec. 4, 2003

(65) Prior Publication Data

US 2005/0120742 A1 Jun. 9, 2005

(51) Int. Cl.

| | |
|---|---|
| ***A44C 5/00*** | (2006.01) |
| ***A44C 19/00*** | (2006.01) |
| ***A44C 9/02*** | (2006.01) |
| ***A44C 17/02*** | (2006.01) |

(52) U.S. Cl. ..... 63/3.1; 63/3; 63/15; 63/15.2; 63/26; 63/30; 63/15.3; 63/15.4; 63/15.45; 63/5.1; 63/11

(58) Field of Classification Search ..... 63/3.1, 63/26, 29.1, 33, 11, 3, 5.1, 15, 15.1, 15.2, 63/15.3, 15.4, 15.45, 30
See application file for complete search history.

(56) References Cited

U.S. PATENT DOCUMENTS

| | | | | | |
|---|---|---|---|---|---|
| 581,922 | A * | 5/1897 | Schrader | 63/15.7 |
| 755,654 | A * | 3/1904 | Guild | 63/28 |
| 854,158 | A * | 5/1907 | Engelsman | 63/30 |
| 899,296 | A * | 9/1908 | Elliot | 63/29.1 |
| 1,440,229 | A * | 12/1922 | Mestekin | 63/28 |
| 1,864,371 | A * | 6/1932 | Prussian | 63/29.1 |
| D114,649 | S * | 5/1939 | Simon | D11/89 |
| 2,763,140 | A * | 9/1956 | Lutrario | 63/15.7 |
| 2,811,024 | A * | 10/1957 | Thompson | 63/26 |
| D199,500 | S * | 11/1964 | Hazeluist | D11/36 |
| 3,601,178 | A * | 8/1971 | Marticorena | 164/45 |
| 3,898,869 | A * | 8/1975 | Reneer | 63/15 |
| 4,220,017 | A * | 9/1980 | Freeman | 63/15 |
| 4,292,818 | A * | 10/1981 | Vitau | 63/28 |
| 4,392,289 | A * | 7/1983 | Michaud | 29/896.41 |
| 4,794,766 | A * | 1/1989 | Schunk et al. | 63/15 |
| 5,036,682 | A * | 8/1991 | Kennedy | 63/28 |
| 5,377,506 | A * | 1/1995 | Tranzer | 63/28 |
| 5,419,158 | A * | 5/1995 | Sandberg et al. | 63/15.4 |
| 5,433,090 | A * | 7/1995 | Santiago | 63/29.1 |
| 5,596,887 | A * | 1/1997 | Bergagnini | 63/15.1 |
| 5,735,144 | A * | 4/1998 | Gabel | 63/15.1 |
| 5,848,539 | A * | 12/1998 | Ouzounian | 63/28 |
| 6,094,939 | A * | 8/2000 | Gavello | 63/3 |
| 6,453,701 | B1 * | 9/2002 | Katz | 63/26 |
| 6,490,886 | B1 * | 12/2002 | Steinhauer et al. | 63/15 |
| D473,812 | S * | 4/2003 | Itzkowitz | D11/36 |
| 6,568,213 | B2 * | 5/2003 | Butler | 63/26 |
| 6,584,804 | B1 * | 7/2003 | Freedman et al. | 63/26 |
| 6,629,434 | B2 * | 10/2003 | Chia et al. | 63/26 |
| 7,201,021 | B2 * | 4/2007 | Hartgrove | 63/29.2 |
| 2004/0177647 | A1 * | 9/2004 | Dennis | 63/29.1 |

* cited by examiner

*Primary Examiner*—J J Swann
*Assistant Examiner*—David C Reese
(74) *Attorney, Agent, or Firm*—Steven E. Kahm; Nikolai & Mersereau, P.A.

(57) ABSTRACT

A bezel having a lumen open to the top and bottom and a recessed center section is used both to mount a stone to a piece of jewelry and to function as a clasp for the jewelry. The recessed center section of the jewelry can be coupled to a hook to secure the jewelry to the wearer.

9 Claims, 2 Drawing Sheets

STONE MOUNT AND CLASP FOR JEWELRY

BACKGROUND OF THE INVENTION

I. Field of the Invention

The present invention relates to jewelry. More specifically, the present invention provides a unique combination clasp and stone mounting for a bracelet, necklace or the like.

II. Description of the Related Art

Jewelry items have been made and worn for centuries. Bracelets and necklaces date back to ancient Egypt and even earlier. Jewelry items have been found throughout recorded history in virtually every culture and civilization.

Many different clasp arrangements have been used to join the opposite ends of a bracelet or necklace together after the jewelry item has been placed about the neck, wrist or ankle. Also, many different types of settings exist to permit a stone to be mounted to the bracelet or necklace. However, very few jewelry pieces incorporate structure that constitutes both a part of a clasp and a mounting for a decorative stone.

SUMMARY OF THE INVENTION

A first object of the present invention is to provide an improved clasp for jewelry items.

A second object of the present invention is to provide an improved clasp that also serves as a secure mount for a decorative stone.

Still another object of the present invention is to provide a secure mount that is open to the top and bottom so that the stone and interior of the mount can be easily cleaned.

These and other objects of the invention are achieved by providing a piece of jewelry that includes a wire band having a clasp comprising a hook formed at one end of the band and a bezel connected to the other end of the band. The exterior of the bezel preferably has an hourglass shape so that it is wider at the top and bottom and narrower at the center. When the jewelry piece is wrapped about a body part such as the wrist or neck, the bezel is moved into the hook such that the hook engages the narrower center of the bezel. The wider top and bottom prevent the hook from slipping off the bezel.

Preferably the wire band has a spring characteristic between 5 and 7 dies hard. If the spring characteristic is less than 5 dies hard, the band will not maintain its shape and the hook will not be held with sufficient force to the hourglass-shaped bezel. If the spring characteristic is greater than 7, the wire band will be too brittle and crack due to metal fatigue over time.

The bezel preferably has an interior lumen that extends the entire length of the bezel. The top and bottom of the bezel are both preferably open to the lumen. The wall of the lumen preferably includes a seat upon which a decorative stone may be mounted. A plurality of notches or recesses can also be provided. These notches receive stone setting beads to secure the stone in place. Since both ends of the bezel are open to the lumen, the lumen (as well as the top and bottom of the stone) can easily be cleaned.

DETAILED DESCRIPTION OF A PREFERRED EMBODIMENT

Figure 1:
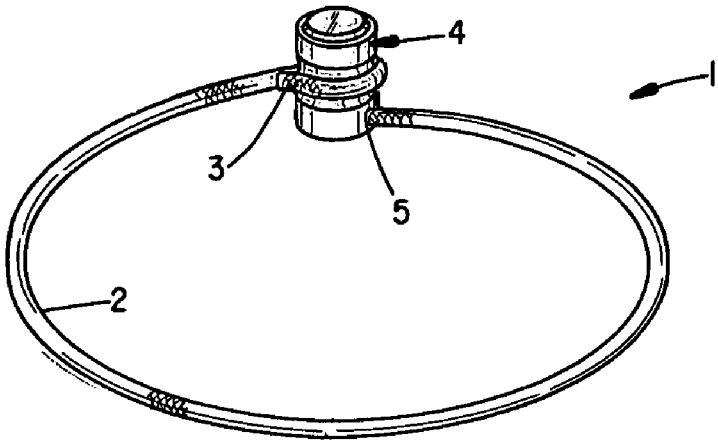
FIG. 1 is a perspective view of a jewelry piece incorporating the present invention.

FIG. 1 shows a jewelry piece 1. The jewelry piece includes a metal wire band 2. Formed at one end of the wire band 2 is a hook 3. The opposite end of the wire band 2 is joined to a bezel 4. The joint 5 between the wire band 2 and the bezel 4 is preferably a solder joint. The wire band has certain spring characteristics. Preferably the metal of the wire band 2 is between approximately 5 and 7 dies hard to give the metal sufficient spring characteristics without being too brittle.

Figure 2:
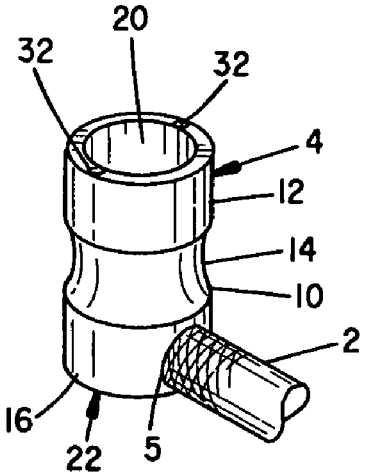
FIG. 2 is a perspective view showing the bezel soldered to one end of a wire band.
Figure 3:
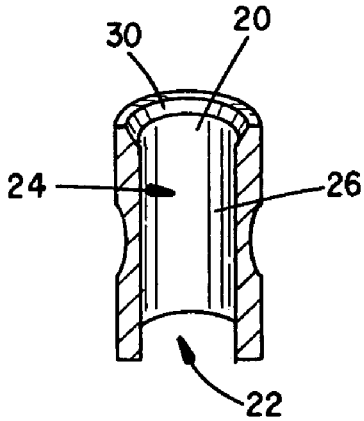
FIG. 3 is a cross-section of the bezel.
Figure 4:
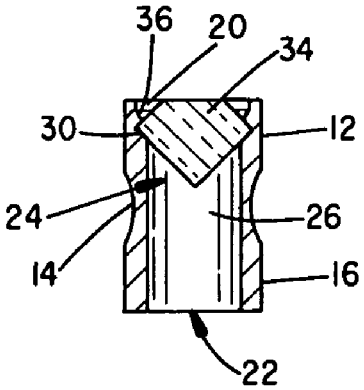
FIG. 4 is a cross-section of the bezel showing a stone mounted in the lumen.

As shown in FIG. 2-4, the bezel 4 is elongated. The bezel 4 has an exterior wall 10 having a top section 12, a center section 14 and a lower section 16. The joint 5 between the band 2 and the bezel 4 is located at the lower section 16 of the bezel 4.

The upper section 12 and the lower section 16 have generally cylindrical shapes. The center section 14 provides a recessed area. As such, the exterior wall 10 of the bezel 4 is shown as having an hour-glass shape. Other shapes can also be used without deviating from the invention so long as the exterior wall has a recessed area.

The bezel 4 has a top opening 20 and a bottom opening 22. Extending between openings 20 and 22 is a lumen 24 having a lumen wall 26. The lumen wall 26 is generally cylindrical in shape.

Associated with the top of the lumen 24 is a frusto-conical seat 30. The lumen wall 26 also has a pair of recesses 32 above the seat 30. FIG. 4 shows a stone 34 placed within the lumen 24 and resting on the seat 30. Also shown are a pair of seat beads 36 inserted into the recesses 32 to secure the stone 34 in place in the bezel 4. The edges of the stone 34 are, in essence, pinched between the seat 30 and the seat beads 36. The stone 34 and lumen 24 of the bezel 4 can be easily cleaned because of the top and bottom openings 20 and 22.

The design of bezel 4 is particularly advantageous because it permits a stone mounted to the bezel 4 to be easily cleaned. During the course of wearing jewelry, water, perfume, lotion, body oils, dirt and other grime can seep through the top into the back of a standard bezel causing the stone to have a dark or cloudy appearance. No manner of cleaning, soaking, boiling, ultrasonic cleaning or steaming can remove such deposits once they have penetrated into a standard closed-base bezel. The design of bezel 4 solves these problems and permits the bezel 4 and stone 34 to be cleaned in a variety of ways restoring the original beauty of the stone.

Figure 5A:
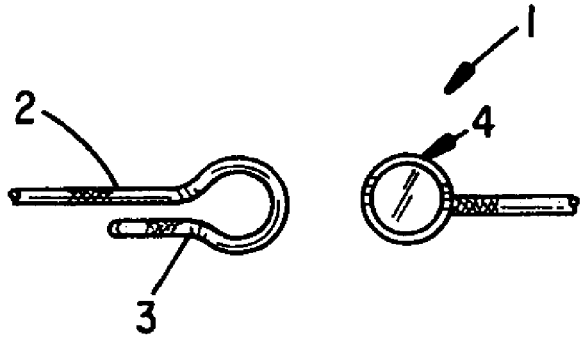
FIGS. 5A-5C show how a hook at one end of the wire band is secured to the bezel attached to the other end of the wire band.
Figure 5B:
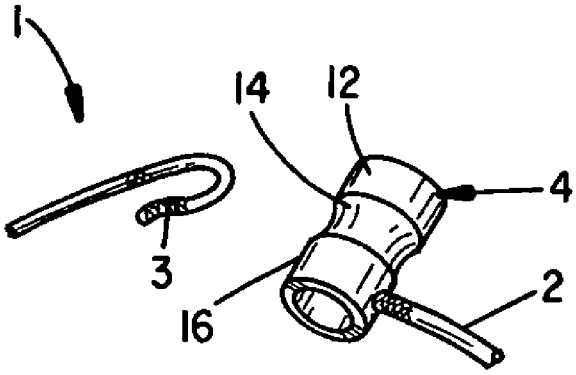
Figure 5C:
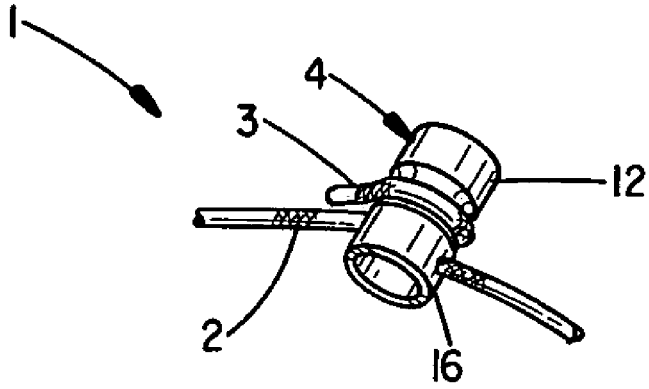

As shown in FIG. 1 and further demonstrated by FIGS. 5A-5C, the bezel 4 and the hook 3 cooperate to provide a clasp joining the two ends of the jewelry piece 1 together. The hook 3 is pushed past the bezel 4 and the opening of the hook 3 then receives the center section 14 of the bezel 4. The wider top section 12 and the lower section 16 prevent the hook 3 from moving up and down across the outer surface of the bezel past the top or bottom of the bezel 4. The spring characteristics of the metal wire band 2 hold the inside of the hook 3 tightly against the center section of the bezel 4 to secure the two ends together so the jewelry piece 1 can be worn. To disconnect the hook 3 from the bezel 4, all one needs to do is provide sufficient force to overcome the spring force of the wire band 2 so the hook 3 and bezel 4 are freed from each other. Thus, the spring characteristics of the band 2, the hook 3 and bezel 4 all cooperate to provide adequate latching together of the two ends of the jewelry piece.

The bezel of the present invention can be formed in a number of ways. For example, a lost wax casting method can be employed using a hollow or tubular sprue that matches the inside and outside diameters of the bezel. When the bezel casting is removed from the hollow or tubular sprue, it is ready for finishing without further drilling or filing.

Those skilled in the art will appreciate from the foregoing that various modifications to the preferred embodiment disclosed can be made without deviating from the invention. Thus, the following claims are provided to define the scope of the invention.

What is claimed is:

1. A piece of jewelry comprising:

a hollow bezel having an open top, an open bottom, an inside wall defining a lumen extending between said open top and said open bottom, a seat within said lumen, and an outside wall having an exterior recessed section proximate the middle of the bezel with the recessed section extending around the entire circumference of the bezel, the bezel having an upper portion above the bezel exterior recessed section and a lower portion below the bezel exterior recessed section;

a stone mounted at least partially within said lumen of said bezel and in contact with said seat; and a band having a first end attached to the exterior wall of the lower portion of the bezel, a hook at a second end of said band and having an opening sized to receive the recessed section of said bezel to clasp the two portions of the band together, wherein when said hook has received the recessed section of said bezel, the hook is impeded from detaching from the bezel by either the top or bottom of said bezel.

2. The piece of jewelry of claim 1 wherein said band comprises at least one metal wire.

3. The piece of jewelry of claim 1 wherein said band has spring characteristics such that the band, hook and bezel all cooperate to hold the inside of the hook against the exterior recessed section of the bezel as the piece of jewelry is worn.

4. The piece of jewelry of claim 3 wherein said spring characteristics of the band are between approximately 5 and 7 dies hard.

5. The piece of jewelry of claim 1 wherein the outside wall of said bezel has a substantially hour-glass shape.

6. The piece of jewelry of claim 1 further including a pair of recesses above the seat, a seat bead positioned within each of said recesses such that the edge of the stone is held in place between said seat beads and said seat.

7. The jewelry piece of claim 1 wherein said bezel is formed using a lost wax casting processes and a sprue that matches the inside and outside walls of said bezel.

8. A jewelry piece comprising:

(a) a band having first and second ends;

(b) a bezel having an outside wall comprising a top section, a bottom section and a recessed center section around the circumference of the exterior wall, an open top, an open bottom, and an inside wall defining a lumen extending between said open top and open bottom, and a lumen wall having a seat, and at least one recess;

(c) the bezel bottom section secured to the first end of the band, a hook formed at said second end of the band;

(d) a stone positioned at least partially within said lumen and in contact with said seat; and (e) a seat bead positioned within said recess cooperating with said seat to hold said stone to said bezel, wherein said hook receives said recessed center section of said bezel to secure said first and second portions of said band together.

9. The jewelry piece of claim 8 wherein said bezel is formed using a lost wax casting process and a hollow sprue that matches the inside and outside walls of the bezel.

* * * * *